United States Patent [19]

Bell et al.

[11] Patent Number: 4,967,330

[45] Date of Patent: Oct. 30, 1990

[54] LED LAMP WITH OPEN ENCASEMENT

[76] Inventors: Howard F. Bell, P.O. Box 1727, Lake Panasoffkee, Fla. 33538; Michael C. Lane, 337 E. Halifax, Mesa, Ariz. 85201

[21] Appl. No.: 494,686

[22] Filed: Mar. 16, 1990

[51] Int. Cl.[5] ..... F21V 3/00

[52] U.S. Cl. ..... 362/311; 362/362; 362/368; 362/373; 362/800

[58] Field of Search ..... 362/800, 373, 311, 362, 362/368

[56] References Cited

U.S. PATENT DOCUMENTS

| | | | |
|---|---|---|---|
| 3,300,638 | 1/1967 | Sloan | 362/368 |
| 4,035,681 | 7/1977 | Savage | 362/311 |
| 4,364,107 | 12/1982 | Wieczorek et al. | 362/800 |
| 4,774,643 | 9/1988 | McGinnis | 362/800 |

*Primary Examiner*—Carroll B. Dority

*Attorney, Agent, or Firm*—Steven R. Scott

[57] ABSTRACT

An LED lamp having a generally hollow cylindrical encasement having at least one opening therein allowing gases and fluids exterior to said encasement to freely circulate within the interior thereof for cooling purposes and including also embodiments wherein said encasement is screwthreaded, and/or is divided into sections with differing diameters.

20 Claims, 3 Drawing Sheets

LED LAMP WITH OPEN ENCASEMENT

BACKGROUND OF INVENTION

1. Field of the Invention

This invention relates generally to the field of lamps or light sources designed for insertion into existing A.C. or D.C. sockets and drawing their energy therefrom. More particularly, it relates to a lamp having a generally cylindrical open encasement suited for use with Light Emitting Diodes (LEDs), allowing them to be more readily used in standard lamp sockets and, more particularly, as replacements for what are commonly referred to as "miniature lamps".

2. Description of the Prior Art

Electrically powered lamps in all sizes are, of course, an ubiquitous part of current technology. In one category alone, referred to in the art area as "miniature lamps", there are (including variations in size) more than two hundred (200) incandescent configurations intended for various specialized uses. The encasement described herein is expandable to meet the requirements of larger lamps that produce more light and consume more electricity. However, it is more specifically intended to facilitate the replacement of most current miniature lamps having an incandescent filament suspended in a clear bulb as their light producing element with lamps utilizing an LED as their light producing element.

The advantages inherent in such replacement are principally derived from the LED's greater efficiency (in terms of energy consumption) and durability when compared to incandescents. The incandescent consumes copious amounts of energy, converting a very high percentage of same into waste heat. LED's consume very little energy in proportion to the light produced and, conversely, produce very little waste heat. Further, the incandescent is, by its nature, extremely fragile when compared with LED light sources. First, it is sensitive to excessive amperages, which will burn out the filament. Second, it is sensitive, both because of its glass globe and the thin filament it utilizes as its light producing element, to rough handling, and breaks easily. The filament is especially prone to this problem due to weakening caused by the excessive heating of its metal during operation. Finally, most incandescents produce only white light. Many applications, particularly in military areas, require the use of low intensity colored light. LEDs generally produce such light, but current incandescent sources must be reduced in intensity and colored by filters to produce same. Thus, in these areas, as in many others, the incandescent is a wasteful alternative when compared with the LED.

Two U.S. patents issued for LED lamps are representative of those seeking to exploit these features: U.S. Pat. No. 4,211,955 issued to Stephen W. Ray and U.S. Pat. No. 4,727,289 issued to Akio Uchida. The Ray patent describes an area-illuminating solid state lamp having the appearance of a standard incandescent light bulb with LEDs enclosed within a globe of solid translucent plastic. It also illustrates the two features necessary for the utilization of LEDs in this application—a current adjustment element (in this case featuring a rectifier as well as a resistor) and a generally cylindrical base capable of interfacing with standard incandescent light sockets. However, it is seriously restricted in use because of the closed nature of its encasement. The performance of LEDs degrades as temperature (generated by current reducing/control elements) becomes elevated. The closed nature of the Ray device causes the accumulation of waste heat generated by the device. A solution to this problem is attempted by Uchida, who utilizes an annular-shaped resistor fitted around the stem of the lamp as a means of overcoming this problem; however, the solution utilized herein is far simpler, and leads to a device that overcomes the temperature build-up problems of prior patents, is far simpler and less expensive to manufacture, and has numerous additional advantages as set forth below.

SUMMARY AND OBJECT OF INVENTION

The LED Lamp with Open Encasement described herein can be broadly divided into an external element and internal elements. The external element is principally comprised of a generally hollow cylindrical encasement (replacing the cylindrical base and globular transparent enclosure for the light producing element found in prior patents) having a first (positive) electric contact at one end (its "base"), and a second (negative) electric contact on its surface separated from said first contact by non-conducting material. The internal elements, which are located within the generally hollow interior of the external element, consist of at least one LED having its positive and negative leads, respectively, connected to said first and second electric contacts and, for most purposes, a current adjustment element (generally a simple resistor) connected between one of said leads and its contact. The LED(s) orientation is such that the light producing portion thereof is directed away from the previously described base of the external element toward the opposite end thereof, referred to herein as the "aperture". An opening or openings, in the base, aperture, or surface of the external element allow(s) air external to the apparatus to freely circulate around the previously described internal elements for cooling purposes.

The objects of this novel design are numerous. First, the open nature of the encasement, particularly of the section of said encasement between the electric contact at its base and the LED(s) enclosed, allows heat generated by the current adjustment element to readily escape. Second, its construction is much simpler than the prior LED lamps described as there is no sealed or closed container to be constructed and its component parts are easily manufactured using simple techniques from readily available materials and parts. Third, it is readily adapted for use and insertion into a wide variety of sockets and, where desirable, for insertion into a socket from the socket's rear, rather than forward side. Other and additional advantages are more fully explored in the detailed description below.

DETAILED DESCRIPTION

Figure 1:
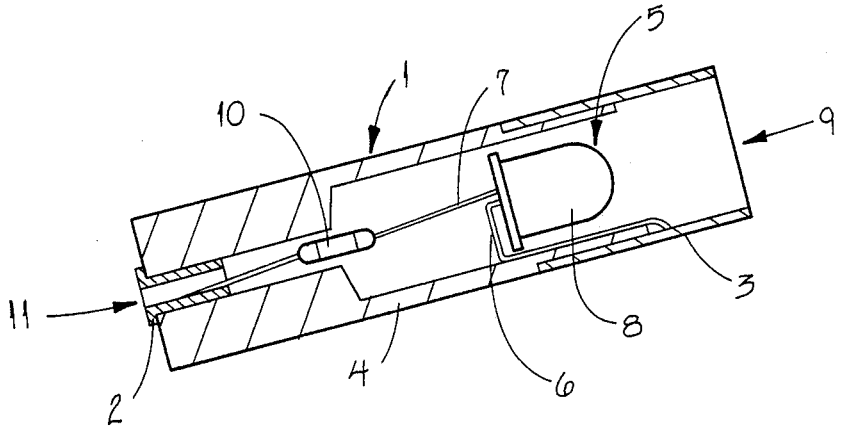
FIG. 1 illustrates, in cross-section, a basic configuration of the LED lamp taught herein, wherein its hollow encasement is open at both base and aperture and is of a uniform diameter.

In one of its simplest configurations, as shown in FIG. 1, the LED lamp taught by this invention is comprised of a hollow, cylindrical encasement 1; having an electrically conducting base contact 2; an electrically conducting cylindrical surface contact 3; a non-conducting portion 4 serving to separate said contacts; and a LED 5 having its negative lead 6 electrically connected to said surface contact 3, its positive lead 7 electrically connected to said base contact 2, and the axis of its light producing portion 8 aligned with the axis of the encasement 1 and directed away from said base contact 2 toward the aperture 9. A current adjustment element 10 is electrically connected between the positive lead 7 and the base contact 2. The current adjustment element 10 will generally be comprised of a simple resistor of resistance sufficient to reduce current flow through the LED to the maximum allowable for the particular LED used. In this configuration the base contact 2 is annular, creating an opening 11 in the base and allowing air exterior to the encasement 1 to freely circulate, for cooling purposes, through the interior thereof.

It is advantageous for the previously described parts to have the following additional characteristics. The nonconducting portion 4 of said hollow encasement 1 is most suitably formed from a transparent plastic material such as LEXAN or an Acrylic. This allows maximum dispersion of light where the light producing portion of said LED 5 is not otherwise circumferentially enclosed. More importantly, however, it allows ready visual identification of the resistor used for purpose of matching the LED lamp taught herein with a current source of appropriate magnitude. The material is also readily machined or injection molded and may, therefore, be easily produced with screwthreading (where screwthreading is required for the application) and may be easily notched and marked for tactile identification in the dark (an important feature where military use is contemplated). Further, its extreme toughness adds to the durability inherent in this design.

It is also advantageous for the hollow encasement 1 to extend beyond and enclose the light producing portion 8 of the LED 5. This provides a shield for the LED 5, helps in maintaining the proper alignment of same, and provides a surface that may be threaded or otherwise appropriately adapted for reverse insertion. In many applications where LEDs may be used, such as instruments panels and map boards, the ability to insert a lamp from the rear of the socket or panel rather than being required to insert same from the front thereof greatly facilitates the replacement of worn out or damaged lamps, substantially reducing labor time and costs.

The embodiment described is subject to numerous modifications without exceeding the ambit of this invention. First, as previously alluded to, any part of the encasement 1, due to its generally cylindrical shape, may be threaded. Second, due to the fact that the light producing element of the design (LED 5) is not covered by a bulb (bulbs generally having diameters exceeding that of the base and socket of a lamp) it may, where the application allows, be inserted from the rear of a socket as well as from the front. Third, the shape of the open encasement is subject to various changes. Thus, various portions may have, by way of example, larger or narrower diameters where the application requires. This may include selective widening of a portion of its encasement to form a flange where same is required for the application in question (such as replacement of many flashlight lamps held in position via flanges between their bulbs and base sections). Fourth, the shape and location of the surface contact 3 is subject to numerous modifications. Thus, it may only cover some small portion of the encasement 1 or a substantial portion thereof. It is subject to variation in size like the encasement 1 and may be located closer to one end of the encasement 1 or the other. Fifth, the location of the LED 5 within the encasement 1 may vary widely, and may even extend beyond the encasement. Sixth, the location and number of openings by which air exterior to the encasement 1 is able to circulate into and through the interior of same is subject to numerous variations. However, despite the variations possible, certain factors remain constant: (a) the generally clindrical nature of the encasement 1; (b) the generally open nature of the encasement 1 (in all cases allowing fluids or gases outside the encasement 1 to freely circulate around the current reduction element 10); (c) the presence of a positive base contact 2 and a negative surface contact 3 separated therefrom by a nonconducting portion 4, each being electrically connected to the matching leads of a LED directed away from the said base contact 2.

Figure 2:
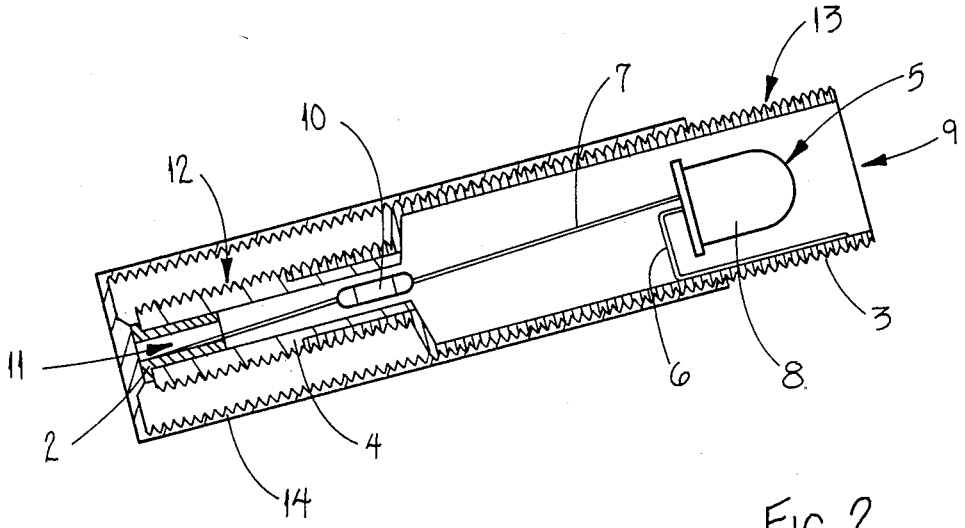
FIG. 2 illustrates, in cross-section, a configuration of the LED lamp taught herein having its hollow encasement divided into two sections of differing diameters, said lamp being shown inserted into a socket having a diameter substantially identical to the larger section.
Figure 3:
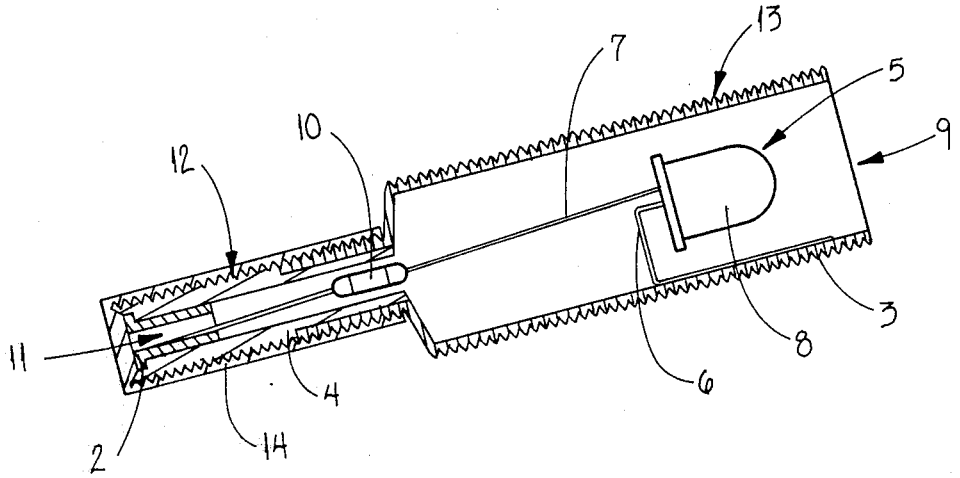
FIG. 3 illustrates, in cross-section, a configuration of the LED lamp taught herein having its hollow encasement divided into two sections of differing diameters, said lamp being shown inserted into a socket having a diameter substantially identical to the smaller section.
Figure 4:
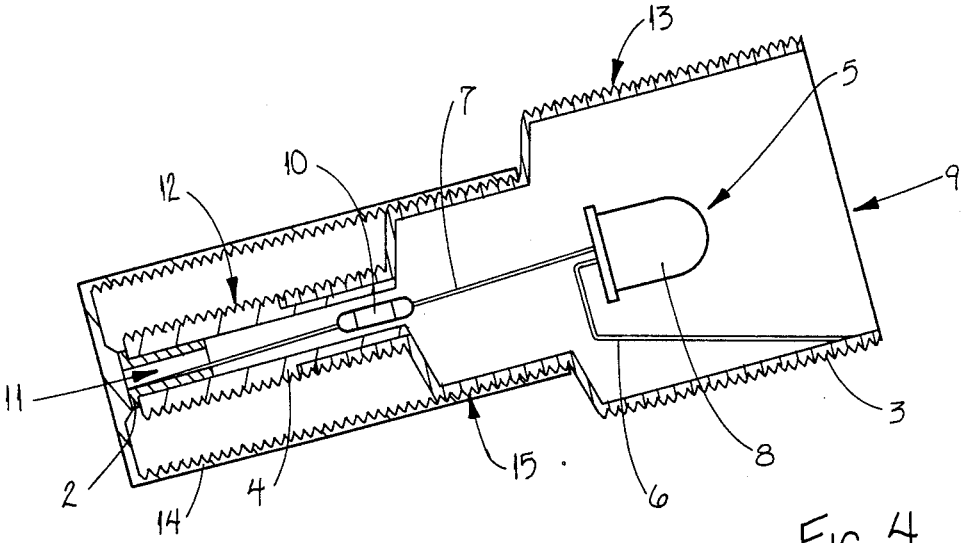
FIG. 4 illustrates, in cross-section, a configuration of the LED lamp taught herein having its hollow encasement divided into three sections of differing diameters, said lamp being shown inserted into a socket having a diameter substantially identical to the middle section.
Figure 5:
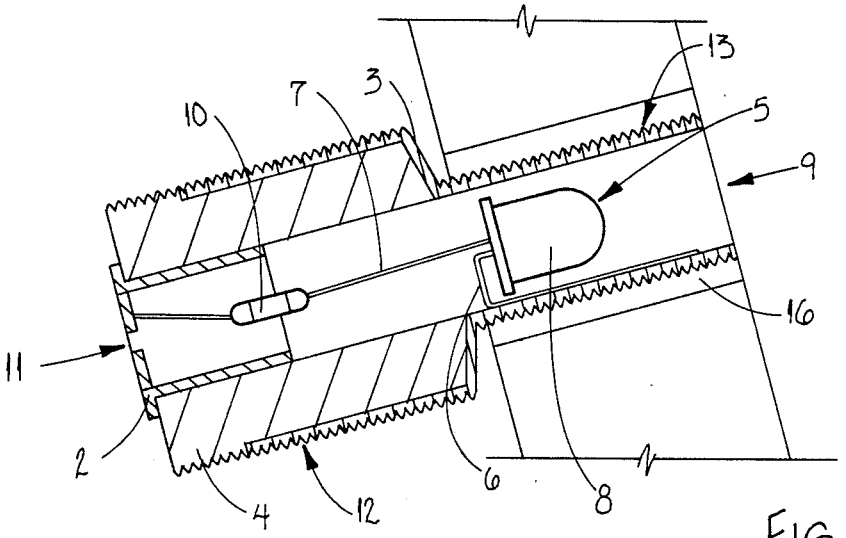
FIG. 5 illustrates, in cross-section, a configuration of the LED lamp taught herein having its hollow encasement divided into two sections with the section having the narrower diameter proximate the aperture of the encasement, said lamp being shown inserted from the rear into a socket having a diameter substantially identical to that of the narrower section.

FIGS. 2 and 3 illustrate a second embodiment of the instant invention wherein the encasement 1 is essentially divided into two sections with different diameters, here a rear section 12 and a forward section 13, said lamp being inserted into socket 14. This design allows utilization of the same LED lamp produced in accordance with the invention in sockets of differing sizes. Thus, in a socket 14 having a diameter substantially identical to the forward section 13, said section will engage the socket 14 in the manner shown in FIG. 2. However, in a socket 14 having a diameter substantially identical to that of the rear section 12, as shown in FIG. 3, said section will engage the socket 14 with forward section 13 basically being excluded therefrom. The ambit of this aspect of the invention is not, however, limited to designs of merely two diameters, nor is it limited to designs wherein the diameter of the sections tapers toward the base. Thus, as shown in FIG. 4, a design with three or more diameters may also be produced without exceeding the ambit of this invention. Here, the middle section 15 interfaces with the socket 14. Further, as shown in FIG. 5, a configuration which tapers toward the aperture is particularly suited for insertion from the rear of open ended socket 16, giving the same flexibility in this case as is produced by the prior configurations when inserted into a socket 14 in the normal manner.

Figure 6:
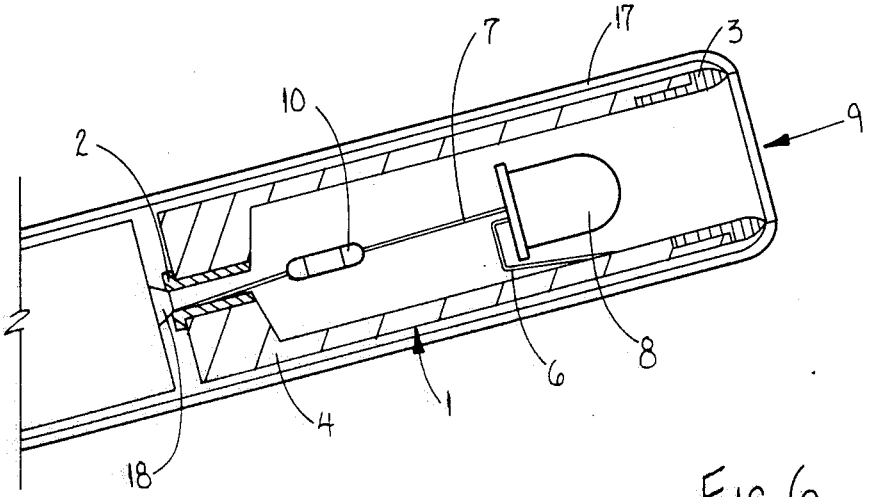
FIG. 6 illustrates, in cross-section, a configuration generally suitable for use in a penlight.

Another configuration, as illustrated in FIG. 6, demonstrates an encasement 1 in which the surface contact 3 has been reduced to an annular ring surrounding the aperture of the lamp. As illustrated in FIG. 6, this design is particularly suitable for penlight use, where the penlight barrel 17 serves as a conducting negative contact for the lamp and the battery's anode 18 is in conducting contact with the base contact 2. The circuit between the cathode of the battery and the penlight barrel 17 is completed by switching means well known in the art.

Figure 7:
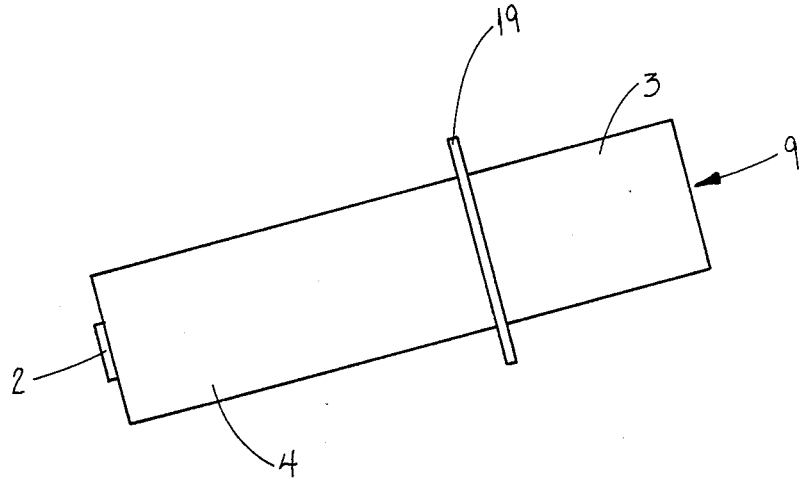
FIG. 7 illustrates a configuration of the LED lamp taught herein having a small portion of its hollow encasement selectively widened to form a flange.
Figure 8:
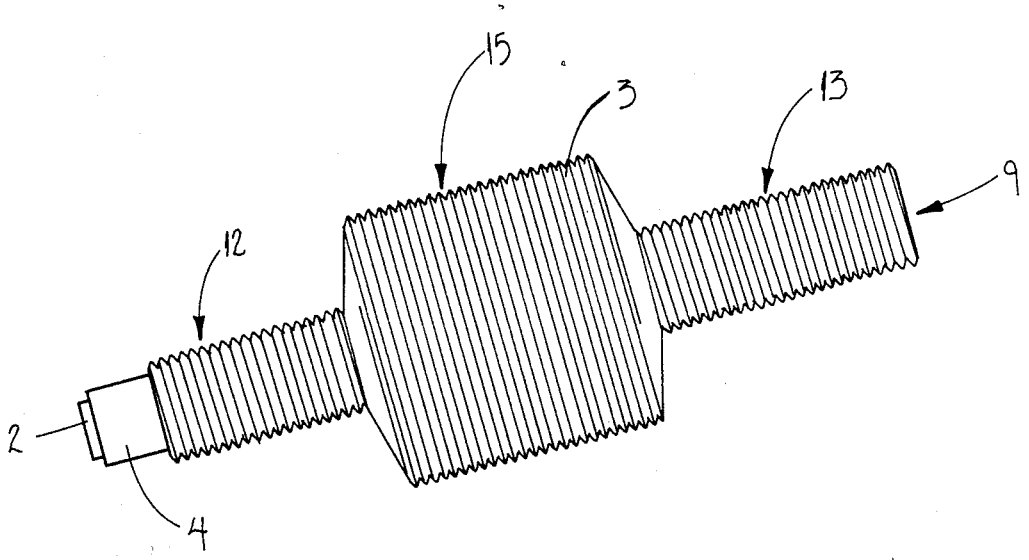
FIG. 8 illustrates a configuration of the LED lamp taught herein wherein its hollow encasement is divided into three sections of differing diameters, the middle section being the widest.

Finally, as previously alluded to, this invention includes within its ambit embodiments wherein the encasement is selectively widened, as shown in FIG. 7, to produce a flange 19. This embodiment is particularly useful as a replacement for many current flashlight lamps. It can as shown in FIG. 7, be unthreaded, or as shown on prior figures, be provided with screwthreading allowing it to be screwed into a threaded socket. In the alternative, it may be drawn or pressed into a socket by means of a suitable nut. (A means well known and practiced in the art; particularly with respect to flashlight lamps). Further, a embodiment wherein the middle section 15 is wider than the forward section 13 or the rear section 12, as shown in FIG. 8, combines the features of the embodiments shown in FIGS. 2, 3 and 5. Thus, it can be utilized to fit two different sized sockets when inserted in standard fashion. In this respect, it duplicates the features of the embodiments described in FIGS. 2 and 3. However, it can also be inserted from the rear of two different sized sockets and so duplicates the advantages of the embodiment described in FIG. 5.

The lamps described herein have other advantages implicit in their materials and design that do not require additional drawings for purpose of explanation. First, all function equally well underwater. In this regard, it should be clear that any reference to the circulation of air for cooling purposes is by way of practical illustration and not of limitation. Indeed, the cooling function served by this design can take place when the lamp is operated in almost any fluid or gas. The lamp's ability to function well when submerged also illustrates its toughness and durability. Second, the designs shown, wherein the negative lead 6 of the LEDs and the positive lead 7 are extended and electrically connected at opposite ends of the lamp, create a resilient harness for the LED 5 that helps to cushion it from shock and increase its durability. Finally, it must be noted that the configurations shown and described do not exhaust the numerous possibilities implicit in the inventive concept described herein. These can only be defined by reference to the claims that follow.

We claim:

1. An LED Lamp with Open Encasement, comprising:

(a) A generally hollow cylindrical encasement including at least one opening therein allowing gases and fluids exterior to . said encasement to circulate within the interior thereof, means forming an electrically conducting contact on and outer surface of said cylindrical encasement, an electrically conducting contact at a base or end of said cylindrical encasement, means for transmitting light through the end of said cylindrical encasement opposite the aforesaid electrically conducting base contact, and an insulative portion formed from nonconducting materials separating said contacts;

(b) At least one light emitting diode disposed within the interior of said generally hollow cylindrical encasement, having its light producing portion directed away from said base contact and parallel to the axis of said encasement, its positive lead connected to the aforesaid electrically conducting base contact and its negative lead connected to the aforesaid electrically conducting surface contact.

2. An LED Lamp with Open Encasement as set forth in claim 1, further comprising at least one current adjustment element capable of adjusting current flow to the extent required to make same compatible with LED usage interposed in the circuit between at least one of said LED leads and the conducting contact to which it is attached.

3. An LED Lamp with Open Encasement as set forth in claim 1, wherein said generally hollow cylindrical encasement is divided into at least two sections of differing diameters.

4. An LED Lamp with Open Encasement as set forth in claim 2, wherein said generally hollow cylindrical encasement is divided into at least two sections of differing diameters.

5. An LED Lamp with Open Encasement as set forth in claim 3, wherein at least one of said sections forms a flange.

6. An LED Lamp with Open Encasement as set forth in claim 4, wherein at least one of said sections forms a flange.

7. An LED Lamp with Open Encasement as set forth in claim 3, wherein the section with the smallest diameter is proximate to the base of the LED Lamp.

8. An LED Lamp with Open Encasement as set forth in claim 4, wherein the section with the smallest diameter is proximate to the base of the LED Lamp.

9. An LED Lamp with Open Encasement as set forth in claim 3, wherein the section with the smallest diameter is proximate to the end of said cylindrical encasement opposite the electrically conducing base contact.

10. An LED Lamp with Open Encasement as set forth in claim 4, wherein the section with the smallest diameter is proximate to the aperture of the LED Lamp.

11. An LED Lamp with Open Encasement as set forth in claim 1, wherein at least one of said openings is located in the base of the LED Lamp.

12. An LED Lamp with Open Encasement as set forth in claim 2, wherein at least one of said openings is located in the base of the LED Lamp.

13. An LED Lamp with Open Encasement as set forth in claim 1, wherein at least one of said openings is located in the end of said cylindrical encasement opposite the electrically conducting base contact.

14. An LED Lamp with Open Encasement as set forth in claim 2, wherein at least one of said openings is located in the end of said cylindrical encasement opposite the electrically conducting base contact.

15. An LED Lamp with Open Encasement as set forth in claim 1, wherein at least one of said openings is located in and outer surface of said Lamp.

16. An LED Lamp with Open Encasement as set forth in claim 2, wherein at least one of said openings is located in and outer surface of said Lamp.

17. An LED Lamp with Open Encasement as set forth in claim 1, wherein some portion of said generally hollow cylindrical encasement is screwthreaded.

18. An LED Lamp with Open Encasement as set forth in claim 2, wherein some portion of said generally hollow cylindrical encasement is screwthreaded.

19. An LED Lamp with Open Encasement as set forth in claim 3, wherein some portion of said generally hollow cylindrical encasement is screwthreaded.

20. An LED Lamp with Open Encasement as set forth in claim 4, wherein some portion of said generally hollow cylindrical encasement is screwthreaded.

* * * * *